US005168088A

United States Patent [19]

Utz et al.

[11] Patent Number: 5,168,088

[45] Date of Patent: Dec. 1, 1992

[54] METHOD FOR DISPERSING CATALYST ONTO PARTICULATE MATERIAL AND PRODUCT THEREOF

[75] Inventors: Bruce R. Utz; Anthony V. Cugini, both of Pittsburgh, Pa.

[73] Assignee: The United States of America as represented by the United States Department of Energy, Washington, D.C.

[21] Appl. No.: 743,968

[22] Filed: Aug. 12, 1991

Related U.S. Application Data

[62] Division of Ser. No. 531,722, Jun. 1, 1990, Pat. No. 5,096,570.

[51] Int. Cl.[5] ..... B01J 23/74; B01J 21/18; B01J 27/043; B01J 27/20; B01J 37/02; B01J 37/20

[52] U.S. Cl. ..... 502/185; 502/222; 502/338

[58] Field of Search ..... 502/185, 314, 315, 316, 502/222, 180, 336, 332, 335, 338

[56] References Cited

U.S. PATENT DOCUMENTS

| | | | |
|---|---|---|---|
| 3,775,286 | 11/1973 | Mukherjee et al. | 208/10 |
| 4,199,522 | 4/1980 | Murchison et al. | 502/222 X |
| 4,295,996 | 10/1981 | Bearden, Jr. et al. | 502/185 X |
| 4,472,528 | 9/1984 | Berg et al. | 502/220 |
| 4,495,306 | 1/1985 | Budahn et al. | 502/185 |
| 4,689,313 | 8/1987 | Fiato et al. | 502/338 X |
| 4,748,145 | 5/1988 | Wood et al. | 502/335 X |

OTHER PUBLICATIONS

Mitra et al., Fuel Processing Technology, 8 (1984), 283–291.

Charcosset et al., Fuel Processing Tech., vol. 12, (1986), 189–201.

Mukherjee et al., Proceedings: Symposium Chemicals and Oil From Coal, Central Fuel Research Inst., Paper #8, (1972), 116–127.

Andres et al., Fuel, 1983, vol. 62, (1982), 69–72.

Mukherjee and Mitra, Fuel, vol. 63, (1984), 722–723.

*Primary Examiner*—W. J. Shine

*Assistant Examiner*—Douglas J. McGinty

*Attorney, Agent, or Firm*—Hugh W. Glenn; Robert J. Fisher; William R. Moser

[57] ABSTRACT

A method for dispersing finely divided catalyst precursors onto the surface of coal or other particulate material includes the steps of forming a wet paste mixture of the particulate material and a liquid solution containing a dissolved transition metal salt, for instance a solution of ferric nitrate. The wet paste mixture is in a state of incipient wetness with all of this solution adsorbed onto the surfaces of the particulate material without the presence of free moisture. On adding a precipitating agent such as ammonia, a catalyst precursor such as hydrated iron oxide is deposited on the surfaces of the coal. The catalyst is activated by converting it to the sulfide form for the hydrogenation or direct liquefaction of the coal.

16 Claims, 2 Drawing Sheets

METHOD FOR DISPERSING CATALYST ONTO PARTICULATE MATERIAL AND PRODUCT THEREOF

CONTRACTUAL ORIGIN OF THE INVENTION

The U.S. Government has rights in this invention pursuant to the employee/employer relationship of the inventor to the U.S. Department of Energy at the Pittsburgh Energy Technology Center.

This is a division of application Ser. No. 531,722 filed Jun. 1, 1990, now U.S. Pat. No. 5,096,570.

BACKGROUND OF THE INVENTION

The present invention relates to a method for dispersing finely divided catalysts onto the surface of a particulate material. More particularly, it relates to an improved method for dispersing hydrated iron oxide onto the surface of carbonaceous material such as coal in a manner to permit effective catalytic activity at relatively low concentrations of iron.

Iron and other transition metals have been used as dispersed-phase catalysts in processes for the hydrogenation and the direct liquefaction of coal. One major advantage of dispersed-phase catalysts is the potential for once through use with high initial activity. Representative processes of this type are described in U.S. Pat. No. 3,775,286 to Mukherjee et al. and in various technical publications such as Mitra et al., "A Comparative Study on Deposited and Mixed Iron Oxide Catalysts for Hydrogenation of Coal", FUEL PROCESSING TECHNOLOGY, 8(1924) 283-291. In this prior work, hydrated iron oxide was precipitated from solution by the addition of ammonium hydroxide onto particulate coal in suspension. Loadings typically of about 1.9 weight percent iron (19,000 ppm) were employed to obtain acceptable catalytic activity. The intimate mixture of iron and coal could then be drained of excess moisture, dried and subjected to hydrogenation or direct liquefaction of the coal. Prior workers also found the sulfide form of iron to be a more active hydrogenation catalyst.

Other prior workers have employed techniques in which water-soluble iron salts are impregnated into coal through contact with a solution of the salts. On subsequent drying with the gradual removal of water from the coal surfaces, the water-soluble, iron salt migrates into ever smaller water droplets resulting in the crystallization or precipitation of large particles of iron oxide. The inability to retard particle growth resulted in the requirement for high concentrations of iron when impregnated iron precursors were used as coal liquefaction catalysts.

SUMMARY OF THE INVENTION

Therefore in view of the above, it is an object of the present invention to provide a method for dispersing finely divided catalysts onto the surface of particulate support material.

It is also an object of the invention to provide an improved catalytic method for hydrogenating solid carbonaceous material.

It is a further object of the invention to provide a method for preparing a highly dispersed iron catalyst adsorbed onto the surface of a support material.

It is likewise an object of the invention to provide a method for distributing highly dispersed transition metal catalysts onto the surface of a carbonaceous material for hydrogenation.

It is also an object to provide a method for impregnating catalyst precursor into carbonaceous material to provide increased activity at lower catalyst loadings.

In accordance with the present invention, a method for dispersing finely divided catalysts onto the surface of particulate support material involves forming a wet paste mixture of incipient wetness of the particulate material and a solution containing a soluble salt of the catalyst. The wet paste mixture is contacted with an agent capable of reacting with the soluble salt to disperse a catalyst precursor in finely divided form directly onto the support material.

In more specific aspects of the invention, the soluble catalytic salt is selected from iron, cobalt or nickel and the particulate support material can include carbonaceous material such as particulate carbon or carbonaceous fuels such as coal. Other support materials such as alumina are also contemplated. The support material with finely divided, adsorbed catalyst precursor can be uniformly mixed into additional particulate carbonaceous material in preparation for a hydrogenation reaction such as the direct liquefaction of coal.

In other aspects of the invention, a catalytic method of hydrogenating solid carbonaceous material is provided in which a wet paste mixture of particulate carbonaceous material is formed from a liquid solution of soluble transition metal salt with the amount of solution limited to no more than an amount at which incipient wetness occurs. The wet paste mixture is contacted with an agent such as an ammonia affording material to form an insoluble compound such as an oxide of the transition metal onto the surface of the particulate carbonaceous material. The wet paste mixture is then subjected to a catalytic hydrogenation process under hydrogenation conditions such as in the direct liquefaction of coal.

In other aspects of the invention a sulfur affording material is reacted with the catalyst precursor to form a transition metal sulfide which is catalytically active. For instance, pyrrhotite, $Fe_{1-x}S$ can be formed.

In more specific aspects of the invention, the condition of incipient wetness in the wet paste mixture will include sufficient liquid solution to uniformly wet the carbonaceous material but without forming drops of free liquid and the transition metal catalyst concentration is limited to no more than 5000 ppm adsorbed on the carbonaceous material.

DETAILED DESCRIPTION OF THE DRAWING

The present invention is illustrated in the accompanying drawings wherein.

DETAILED DESCRIPTION OF THE INVENTION

Figure 1:
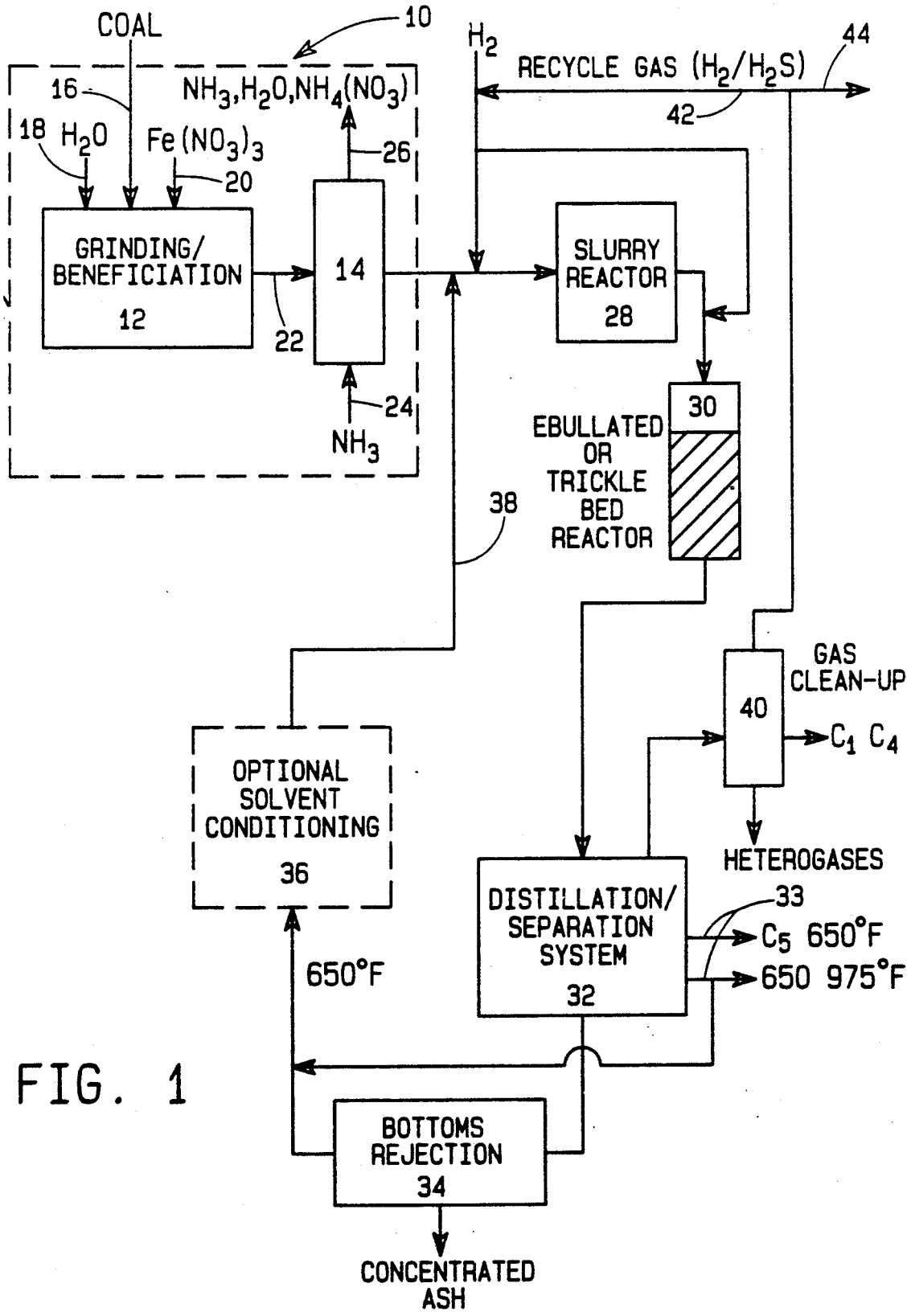
FIG. 1 is a diagrammatic representation of a process for the direct liquefaction of coal including catalyst preparation.

In one manner of carrying out the method of the present invention, a finely divided iron catalyst or catalyst precursor is adsorbed onto the surfaces of particulate coal in the initial steps of a coal liquefaction or other coal hydrogenation process. The method involves precipitating or depositing a catalyst precursor, typically hydrated iron oxide (FeOOH), directly onto the coal surface from a wet paste mixture. In addition to FeOOH, insoluble iron sulfides such as iron pyrite are contemplated as precursors to the active form of the catalyst.

The wet paste mixture can include particulate coal or other carbonaceous material wetted with an aqueous solution of ferric ions limited in volume to no more than that required for incipient wetness. A wet paste of incipient wetness will include that amount of liquid mixed and adsorbed onto a solid material just before drops of free moisture or liquid begin to form. In the case of a wet paste mixture of bituminous particulate coal, incipient wetness typically will occur at about 30% to 50% by weight moisture adsorbed on the coal particles. However, with other solids such as highly porous carbon up to about 75 weight percent moisture may be contained in a mixture of incipient wetness before drops of free liquid appear. In all cases a wet paste of incipient wetness is distinguishable from a suspension of solids in liquid in that all of the liquid is adsorbed on (or absorbed in) the solid without the presence of free liquid.

Inasmuch as all of the solution containing the iron catalyst precursor is adsorbed on the surface of the particulate carbonaceous material, a highly dispersed, iron precipitate can be deposited and maintained in a high dispersion even after drying and conversion to a more active catalytic form. The inventors have found that the precipitated iron compounds, adsorbed on the carbonaceous material in a highly dispersed state are not nearly so subject to nucleation or flocculation as those merely precipitated in mixture with a suspension of carbonaceous material. Thus, extremely small particles of catalytic iron of high activity can be provided on the support material by the process of this invention. The inventors have found that the iron catalyst precursor particles will be no more than about 1000 angstroms in size.

In preparing the wet paste mixture, particulate coal of about 10 to 250 microns particle size is mixed with a solution of soluble iron salts such as ferric nitrate or ferric chloride. The amount of solution is limited to no more than the amount at which incipient wetness occurs. An ammonia affording agent such as ammonia gas or a solution of ammonia hydroxide is brought into contact with the wet paste mixture to precipitate hydrated iron oxide directly onto the particulate carbonaceous material. The wet paste mixture can then be dried and mixed with hydrogenated coal solvent to form the feed to a coal hydrogenation or liquefaction process. At the elevated temperatures required for liquefaction, the catalyst precursor, hydrated iron oxide, reacts with a sulfur affording material such as $H_2S$ or $CS_2$ to convert the iron to its active form generally considered to be a form of pyrrhotite, $Fe_{1-x}S$ where x is between 0.01 and 0.2. Although some sulfur affording agents are expected to be in the coal, it may be required to add the above sulfur affording materials into the liquefaction reactor to fully activate the iron catalyst.

Alternatively, the inventors contemplate precipitating an iron sulfide such as pyrite directly onto the coal particle surfaces within the wet paste mixture. To accomplish this a sulfur affording agent such as $H_2S$, $CS_2$ or $(NH_4)_2S$ will be passed into contact with the wet paste mixture to react with the soluble iron salt.

The following examples are presented merely by way of illustration and are not intended to limit the present invention beyond that defined in the accompanying claims.

EXAMPLE I

About one gram of ferric nitrate, $Fe(NO_3)_3.9H_2O$ is per Amend. A dissolved into 40 grams of distilled water. The solution was added to 50 grams of particulate Illinois #6 coal having a particle size of about 10–15 microns to form a wet paste mixture of incipient wetness. The wet paste was rapidly added to a solution of 20 grams of ammonia hydroxide (29% $NH_3$) and 200 grams of distilled water. The resulting suspension was filtered and the coal solids with adsorbed FeOOH were dried. The dried solids were mixed with tetralin as solvent in a ratio of 2:1 solvent to coal and subjected to direct liquefaction in a microautoclave at a temperature of 425° C., cold pressure of 1000 psig hydrogen (2000 psig at temperature) for a residence time of one hour.

EXAMPLE II

The procedure of Example 1 was followed except 0.1 gram of $CS_2$ was added to the coal/solvent mixture to convert the iron to the sulfide form.

EXAMPLE III (Comparative Example)

One gram of $Fe(NO_3)_3.9H_2O$ was dissolved into 40 grams of distilled water. Twenty grams of ammonia hydroxide (29% in $NH_3$) were added to the solution resulting in precipitation of hydrated iron oxide. The solids were separated by filtration, dried and added to a liquefaction test reactor as FeOOH.

EXAMPLE IV (Comparative Example)

In a procedure similar to that described in U.S. Pat. No. 3,775,286 to Mukherjee et al., FeOOH was precipitated into mixture with a suspension of Illinois #6 coal in ferric nitrate solution. Sufficient FeOOH was included with the coal to provide a catalyst loading of 2500 ppm iron for comparison with the results obtained with the catalyst of Example II. The solids were filtered from solution, dried and processed in a microautoclave as in Example II.

Other comparative microautoclave screening tests were conducted with no catalysts, powdered ferric oxide, powdered pyrite and ammonium molybdate. The results of these tests, along with those of Examples I–IV are presented in Table 1.

TABLE 1

Microautoclave Studies
Temperature - 425° C., Pressure - 2000 psig H2
Residence Time - 1 hour, 2:1 Tetralin to Illinois #6 Coal

| | Coal Conversion to: | |
|---|---|---|
| | Methylene Chloride Solubles | Heptane Solubles |
| Thermal | 59.1 | 27.1 |
| Thermal + $H_2S$ | 59.2 | 32.5 |
| $Fe_2O_3$[1] | 59.2 | 32.1 |
| FeOOH[1] (Example III) | 62.5 | 35.4 |
| FeOOH[1] + $H_2S$ | 71.7 | 42.5 |
| Mukherjee et al. + $H_2S$[2] (Example IV) | 74.2 | 42.9 |
| Impregnated FeOOH[2] (Example I) | 70.4 | 40.8 |
| Impregnated FeOOH[2] + $H_2S$ (Example II) | 85.4 | 62.5 |

TABLE 1-continued

| Microautoclave Studies<br>Temperature - 425° C., Pressure - 2000 psig H2<br>Residence Time - 1 hour, 2:1 Tetralin to<br>Illinois #6 Coal | Coal Conversion to: | |
|---|---|---|
| | Methylene Chloride Solubles | Heptane Solubles |
| Ammonium Molybdate[3] + $H_2S$ | 88.3 | 63.3 |

[1]Catalyst Concentration - 5000 ppm (based on coal)
[2]Catalyst Concentration - 2500 ppm (based on coal)
[3]Catalyst Concentration - 1500 ppm (based on coal)

In addition to the above, experiments were conducted on a batch one-liter autoclave to confirm the results observed in the microautoclaves. The experiments were conducted under the same conditions as the microautoclave tests, however, a coal-derived distillate solvent (V-1074) obtained from run 257 at the Wilsonville Advanced Coal Liquefaction Test Facility was used as the solvent instead of tetralin and a pressure of 2500 psig (3% $H_2S$) was imposed. Experiments using impregnated hydrated iron oxide catalyst were compared to those conducted thermally and with ammonium heptamolybdate. Hydrogen sulfide was added in all of the experiments. The results from these tests are illustrated in FIG. 2 showing the yield structure obtained using the highly dispersed catalyst of this invention to be comparable to the distillate structure using ammonium molybdate.

Figure 2:
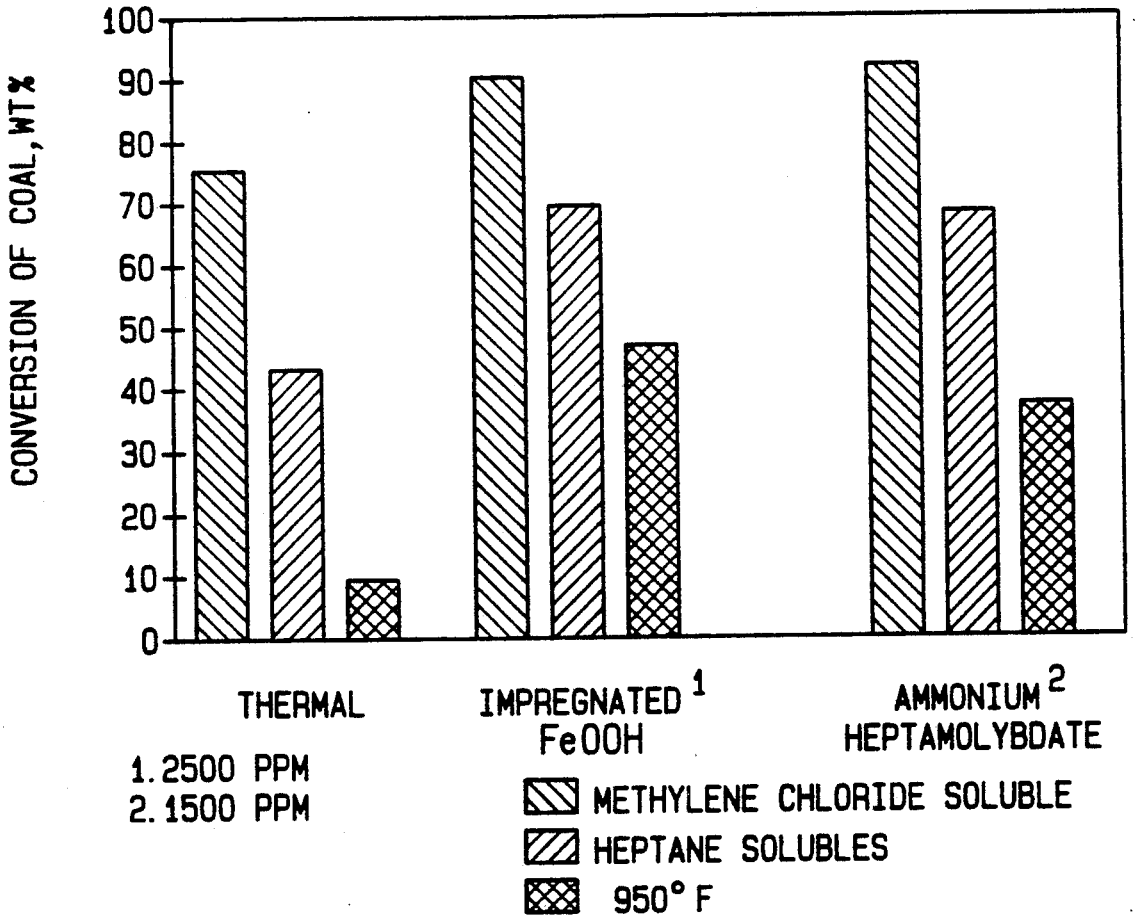
FIG. 2 is a bar graph comparing the conversion of coal by the process of the present invention with that of prior processes.

The catalyst prepared in accordance with Mukherjee et al. was also tested in a one-liter autoclave test, similar to the tests illustrated in FIG. 2. The conversion to −950° F. boiling material (useful in the preparation of transportation fuels) using the Mukherjee preparation procedure was only 37% (not shown in FIG. 2) compared to 48% obtained with the Impregnated FeOOH procedure of this invention.

It is therefore seen that catalysts obtained from the impregnated FeoOH precursor are substantially as effective for coal liquefaction as ammonium molybdate. Through use of the incipient wetness impregnation technique, a high dispersion of the hydrated iron oxide on the coal is formed which acts as a catalyst precursor in coal liquefaction. The coal conversion with iron concentrations as low as 2500 ppm compare favorably with those observed with molybdenum catalyst at 1500 ppm.

It will also be clear that this method of incipient wetness impregnation is applicable to any group VIII metal. For instance, with nickel or cobalt as well as iron. In addition, it is expected that the dispersion of catalytic iron sulfides can be precipitated from an incipient wetness mixture including impregnated ferrous chloride solution by the addition of ammonium sulfide.

In other variations of the invention, iron or other group VIII metal can be precipitated only into a selected fraction of the coal to be hydrogenated. This selected fraction, as wet paste mixture, can then be uniformly mixed with at least an equal weight of particulate carbonaceous material. For instance, 10%–50% of the coal can be spiked with the catalyst precursor and subsequently thoroughly mixed in with the full volume of coal or other carbonaceous material to be liquefied or hydrogenated.

The method is not limited to the dispersion of catalysts onto the carbonaceous material itself but is also applicable to incipient wetness precipitation onto another support material such as highly porous carbon or alumina. The supported catalysts then can be blended with the carbonaceous material in preparation for the hydrogenated process.

One example of the present invention applied to coal liquefaction is illustrated schematically in FIG. 1. The catalyst precursor is conveniently impregnated into the coal in the coal beneficiation step 10. Typically, grinding and aqueous beneficiation 12 are used to pretreat the coal 16 with added water 18. A solution of ferric nitrate 20 can be added to form a wet paste of incipient wetness 22 which is contacted and reacted with ammonia gas 24 during the drying step 14. Conventional packed bed, fluidized bed or other industrial dryers can be selected for use in drying step 14. As described above the ammonia reacts with the wet paste as a part of or prior to drying to deposit a highly dispersed, catalyst precursor, FeOOH, onto the coal surfaces. Unreacted gases and reaction products 26 are withdrawn or conditioned for recycling. The remainder of the FIG. 1 process is a conventional two stage coal liquefaction process with a slurry reactor 28 and ebullated bed reactor 30. Product distillation 32 provides liquefied product 33 and conditioning steps 34 and 36 provide solvent recycle 38. Gas clean-up and separation processes 40 provide recycle $H_2S$ for activation of the catalyst precursor. Excess $H_2S$ can be withdrawn at 44 for further separation and processing.

Although the present invention is described in terms of specific materials and process steps, it will be clear to one skilled in the art that various changes and modifications may be made in accordance with the invention described in the accompanying claims.

The embodiment of the invention in which an exclusive property or privilege is claimed is defined as follows:

1. A method for dispersing finely divided, iron-containing catalyst onto the surface of particulate support material comprising:

forming a wet paste mixture of incipient wetness including the particulate material and a solution containing a soluble iron salt of the catalyst precursor;

contacting the wet paste mixture with an agent capable of reacting with the soluble iron salt to disperse finely divided particles of the catalyst precursor, containing iron, directly on the support material.

2. The method of claim 1 wherein a sulfur-affording material is reacted with the catalyst precursor to form a catalyticly active, iron sulfide.

3. The method of claim 1 wherein the particulate support material containing finely divided, dispersed catalyst is uniformly mixed into additional particulate carbonaceous material in preparation for hydrogenation.

4. An iron-containing, catalyst precursor mixture suitable to afford a catalyst, said mixture comprising particulate material having dispersed particles of an iron compound adsorbed as precipitated from a wet paste of incipient wetness onto the surfaces of the particulate material.

5. The catalyst precursor mixture of claim 4 wherein the iron compound is suitable for reaction with a sulfur-containing material to form a catalyticly active, iron sulfide.

6. The catalyst precursor mixture of claim 5 wherein the iron sulfide is pyrrhotite, $Fe_{1-x}S$, where x is between 0.01 and 0.2.

7. The catalyst precursor mixture of claim 4 in further mixture with at least an equal weight portion of particulate carbonaceous material in preparation for the hydrogenation of the particulate carbonaceous material.

8. The catalyst precursor mixture of claim 4 wherein the iron compound is hydrated iron oxide capable of reacting with a sulfur-containing material selected from the group consisting of $H_2S$ and $CS_2$ to form a catalytically active iron sulfide.

9. The catalyst precursor mixture of claim 4 wherein the particulate material is particulate carbonaceous material with a compound of iron dispersed as finely divided particles of no more than 1000 angstroms size and limited to no more than 5000 ppm based on the carbonaceous material.

10. The method of claim 1 wherein the wet paste mixture is formed by blending an aqueous solution of ferric nitrate or ferric chloride with particulate material and an ammonia-containing material is added to disperse finely divided particles of hydrated iron oxide onto the particulate material.

11. The method of claim 10 wherein the ammonia-containing material is ammonia gas passed into contact with the wet paste mixture following comminution of the particulate material in the presence of ferric nitrate solution.

12. The method of claim 10 wherein a sulfur-containing material selected from the group consisting of $H_2S$ and $CS_2$ is reacted with the hydrated iron oxide to form a catalytically active iron sulfide.

13. The method of claim 1 wherein sufficient catalyst precursor solution is present in the wet paste mixture to uniformly wet the particulate material but without exceeding the liquid required for incipient wetness.

14. The method of claim 13 wherein the catalyst precursor is a compound of iron dispersed as finely divided particles of no more than 1000 angstroms size on the support material.

15. The method of claim 14 wherein the wet past mixture is uniformly mixed with at least an equal weight of particulate carbonaceous material prior to subjecting the mixture to catalytic reaction.

16. An iron-containing, catalyst precursor mixture suitable to afford a catalyst, said mixture comprising particulate carbonaceous material having dispersed particles of hydrated iron oxide adsorbed as precipitated from a wet paste mixture of incipient wetness onto the surfaces of the particulate material, the wet paste mixture including particulate carbonaceous material and aqueous ferric nitrate solution suitable for reacting with ammonia to disperse finely divided particles of hydrated iron oxide onto the carbonaceous material.

* * * * *